US007488879B2

(12) United States Patent
Gotoh

(10) Patent No.: US 7,488,879 B2
(45) Date of Patent: Feb. 10, 2009

(54) PEG FOR STRINGED INSTRUMENT

(75) Inventor: Takao Gotoh, Isesake (JP)

(73) Assignee: Gotoh Gut Co., Ltd. (JP)

( * ) Notice: Subject to any disclaimer, the term of this patent is extended or adjusted under 35 U.S.C. 154(b) by 196 days.

(21) Appl. No.: 11/288,899

(22) Filed: Nov. 29, 2005

(65) Prior Publication Data

US 2006/0117929 A1 Jun. 8, 2006

(30) Foreign Application Priority Data

Nov. 30, 2004 (JP) ..... 2004-346229

(51) Int. Cl.
*G10D 3/14* (2006.01)

(52) U.S. Cl. ..... 84/304; 84/306

(58) Field of Classification Search ..... 84/304, 84/306

See application file for complete search history.

(56) References Cited

U.S. PATENT DOCUMENTS 3,431,807 A 3/1969 Thompson
3,756,112 A * 9/1973 Adams ..... 84/380 B
4,353,280 A 10/1982 Spercel
4,515,059 A * 5/1985 Siminoff ..... 84/306
4,708,895 A * 11/1987 Mizusawa ..... 428/31

FOREIGN PATENT DOCUMENTS

| | | |
|---|---|---|
| DE | 2502601 | 7/1976 |
| EP | 0 798 692 A3 | 11/1999 |
| EP | 1 385 144 A1 | 1/2004 |
| JP | 59-184395 | 10/1984 |

* cited by examiner

*Primary Examiner*—Walter Benson
*Assistant Examiner*—Jianchun Qin
(74) *Attorney, Agent, or Firm*—Thompson Hine LLP

(57) ABSTRACT

A peg for a stringed instrument having a head and a hole formed in the head includes: a main body which is mounted to the head; a worm gear rotatably provided to the main body and having a knob on an end portion thereof; a worm wheel rotatably supported by the main body and engaging with the worm gear; a winding shaft having an axis, the winding shaft connected to the worm wheel and inserted into the hole of the head in the condition that the main body is mounted to the head; and a ring-shaped guide member penetrated by the winding shaft and fitted into the hole of the head. The guide member is inserted to the main body along the axis of the winding shaft so as to be secured to the main body.

4 Claims, 11 Drawing Sheets

PEG FOR STRINGED INSTRUMENT

BACKGROUND OF THE INVENTION

1. Field of the Invention

The present invention relates to a peg for a stringed instrument (for example, a guitar). In particular, the present invention relates to a technique in which a center of a winding shaft is concentric with respect to that of a hole in a head of a stringed instrument.

2. Description of the Related Art

A stringed instrument (for example, a guitar) is equipped with a peg for tuning a string. As shown in FIG. 11, the peg is equipped with a main body 110, a worm gear 120, a knob 130, a winding shaft 140, and a worm wheel 150. The worm gear 120 is rotatably supported by the main body 110. The knob 130 is secured at an end portion of the worm gear 120. The winding shaft 140 is rotatably supported by the main body 110. The worm wheel 150 is connected to an end portion of the winding shaft 140, and engages with the worm gear 120.

The above peg 100 is mounted to a head 200 of a stringed instrument such that the winding shaft 140 penetrates a hole 200*a* formed in the head 200, a winding surface 141 of the winding shaft 140 is projected from the hole 200*a*, the main body 110 is secured on a lower surface of the head 200 by a screw (not shown in the Figure). A string is wound around the winding shaft 140, and the string is wound therearound or released therefrom by rotating the knob 130, so that tuning of the stringed instrument is performed. A guide bush (not shown in the Figure) is fitted into the hole 200*a* from an upper surface of the head 200, and a screw (not shown in the Figure) is tightened in an inside periphery of a guide tube 110*a*, the screw being formed on a small diameter periphery at a front end of the guide bush. As a result, the winding shaft 140 is rotatably supported by the main body 110 and the guide bush, and the main body 110 is secured to the head 200.

In the above peg 100, for example, the guide tube 110*a* is formed by die casting to be integrally combined with the main body 110. The guide tube 110*a* is fitted into the hole 200*a* of the head 200, so that a center of the winding shaft 140 is concentric with respect to that of the hole 200*a*. For example, a peg constructed in the above manner is disclosed in Japanese Unexamined Patent Application Publication No. S59-184395.

In addition to a peg of which the main body is produced in the above manner, a conventional type of peg having no guide tube is widely used in which a main body thereof is formed by performing press-working on a metal plate. In a case in which this type of peg is mounted to a head, first, a guide bush is press-fitted into a hole from an upper side of the head. Next, a winding shaft of the peg is inserted into the hole from a lower side of the head, and is fitted inside the guide bush. Next, a screw penetrates through a mounting hole formed in the main body, and is tightened into a hole formed in the head, so that the main body is mounted to the head. However, since clearance exists between the winding shaft and the guide bush, when a worker aligns the winding shaft with a center of the guide bush, the aligning of the winding shaft largely depends on the judgment of the worker. Since clearance exists between the mounting hole of the main body and the screw penetrating thereinto, the main body shifts from its predetermined mounting position with respect to the head. When the screw is tightened into the hole of the head, the screw is not often inserted straight thereinto. As described above, there are various cases in which the above location shift of the main body occurs when the peg is mounted to the head. As a result, the center position of the peg is eccentric with respect to that of the guide bush, so that the winding shaft is disposed so as to abut the inside wall of the guide bush.

In a peg proposed previously by the inventors in WO Patent Application Publication No. WO02/091350A1, PCT/JP01/03798, a worm wheel is rotated by tension of string, a tooth surface on one side of the worm wheel constantly abuts a toothed wheel on one side of a worm gear. Therefore, since this peg has no play which occurs due to backlash, the worm wheel accurately follows rotation of a knob, and tuning of a stringed instrument can be performed accurately and easily. However, in a case in which the winding shaft is disposed to abut the inside wall of the guide bush as described above, rotational frictional resistance of the winding shaft is large, and the worm wheel cannot be rotated by the tension of the string, so that the backlash functions as play of the rotation. Unusual force is applied to the tooth surfaces of the worm wheel and the worm gear which abut each other, and these parts are thereby soon become worn.

SUMMARY OF THE INVENTION

An object of the present invention is to provide a peg in which a center of a winding shaft can be concentric with respect to that of a hole formed in a head, the peg having a guide tube which is not formed to be combined integrally with a main body thereof. An object of the present invention is to provide a peg for stringed instruments, which thereby can prevent backlash and parts wearing out too soon.

According to one aspect of the present invention, a peg for a stringed instrument having a head and a hole formed in the head includes: a main body which is mounted to the head; a worm gear rotatably provided to the main body and having a knob on an end portion thereof; a worm wheel rotatably supported by the main body and engaging with the worm gear; a winding shaft having an axis, the winding shaft connected to the worm wheel and inserted into the hole of the head in the condition that the main body is mounted to the head; and a ring-shaped guide member penetrated by the winding shaft and fitted into the hole of the head, wherein the guide member is inserted to the main body along the axis of the winding shaft so as to be secured to the main body.

In the peg for a stringed instrument according to the present invention, the ring-shaped guide member penetrated by the winding shaft and fitted into the hole of the head is inserted into the main body along the axis of the winding shaft so as to be fixed thereto. Therefore, when the peg is mounted to the head, the guide member is fitted into the hole of the head, so that the center of the winding shaft can be concentric with respect to that of the hole of the head. Therefore, in case in which a guide bush is inserted into the hole of the head from the surface side, the center of the guide bush is concentric with respect to that of the winding shaft, so that contact of the winding shaft and the guide bush can be prevented. As a result, the worm wheel can be rotated smoothly, and backlash and parts wearing out quickly can be prevented.

According to a preferred embodiment, various structures can be used for mounting the guide member to the main body. For example, the main body can have plural insertion holes which are disposed in a circumferential direction so as to be overlapped with an end surface of the guide member. The guide member can have projections which are inserted into the insertion holes of the main body. In this case, the projections can be press-fitted into the insertion holes, so that assembling can be easy.

According to a preferred embodiment, the guide member can be composed of a metal. In this case, the projections may project from the insertion holes, so that the guide member can be caulked to the main body. However, in caulking the guide member, a clearance between the guide member and the main body may be easily formed, and the guide member thereby moves with respect to the main body. As a result, harmonic noise occurs due to resonance of the guide member when the stringed instrument is played. Therefore, it is preferable that the guide member be composed of a plastic material, and that the projections project from the insertion holes and be melted by heating so as to be secured in the insertion holes. In the securing method of the guide member, it is difficult to form a gap between the guide member and the main body, and noise which occurs due to resonance of the guide member can be prevented. The guide member may be removed from the main body. In this case, if a ring member is composed of a metal the noise is large when the guide member hits the inside wall of the hole. In contrast, if the guide member is composed of a plastic, the noise is small.

According to a preferred embodiment, the projections preferably have a thick portion which projects toward an outside of a radial direction of the guide member. In a case in which the ring member is thin, it is difficult to form narrow insertion holes by press working. In a case in which the projections have a thick portion, the insertion holes can be wide, and the press working can be easily performed. In a case in which the projections project from the insertion holes, and are melted by heating, the projecting amount of the projections can be small, and the melting process can be simple.

According to a preferred embodiment, in another structure for mounting the guide member to the main body, the projections can have hook portions projecting toward the outside in the radial direction. In this case, the projections are elastically deformed inwardly to be inserted into the insertion holes, so that the hook portions elastically return and engage with edge portions of the insertion holes. In this feature, the mounting of the guide member to the main body can be easily performed by one touch. In this feature, a protrusion portion of the projection can be melted by heating and be secured to the opening portion of the insertion hole.

BRIEF DESCRIPTION OF THE DRAWINGS

FIG. 4A is a plan view, FIG. 4B is a cross-sectional view taken along line B-B in FIG. 4A, FIG. 4C is a cross-sectional view showing the condition in which a guide tube is mounted to the main body shown in FIG. 4B, and FIG. 4C is a cross-sectional view showing a modification example of FIG. 4B.

FIG. 5A is a rear surface view, FIG. 5B is a plan view, FIG. 5C is a view viewed from an arrow line C, and FIG. 5D is a cross-sectional view taken along line D-D.

FIG. 10A is a rear surface view, FIG. 10B is a view viewed from an arrow line B in FIG. 10A, and FIG. 10C is a view viewed from an arrow line C in FIG. 10B.

DESCRIPTION OF THE PREFERRED EMBODIMENTS

1. First Embodiment

Figure 1:
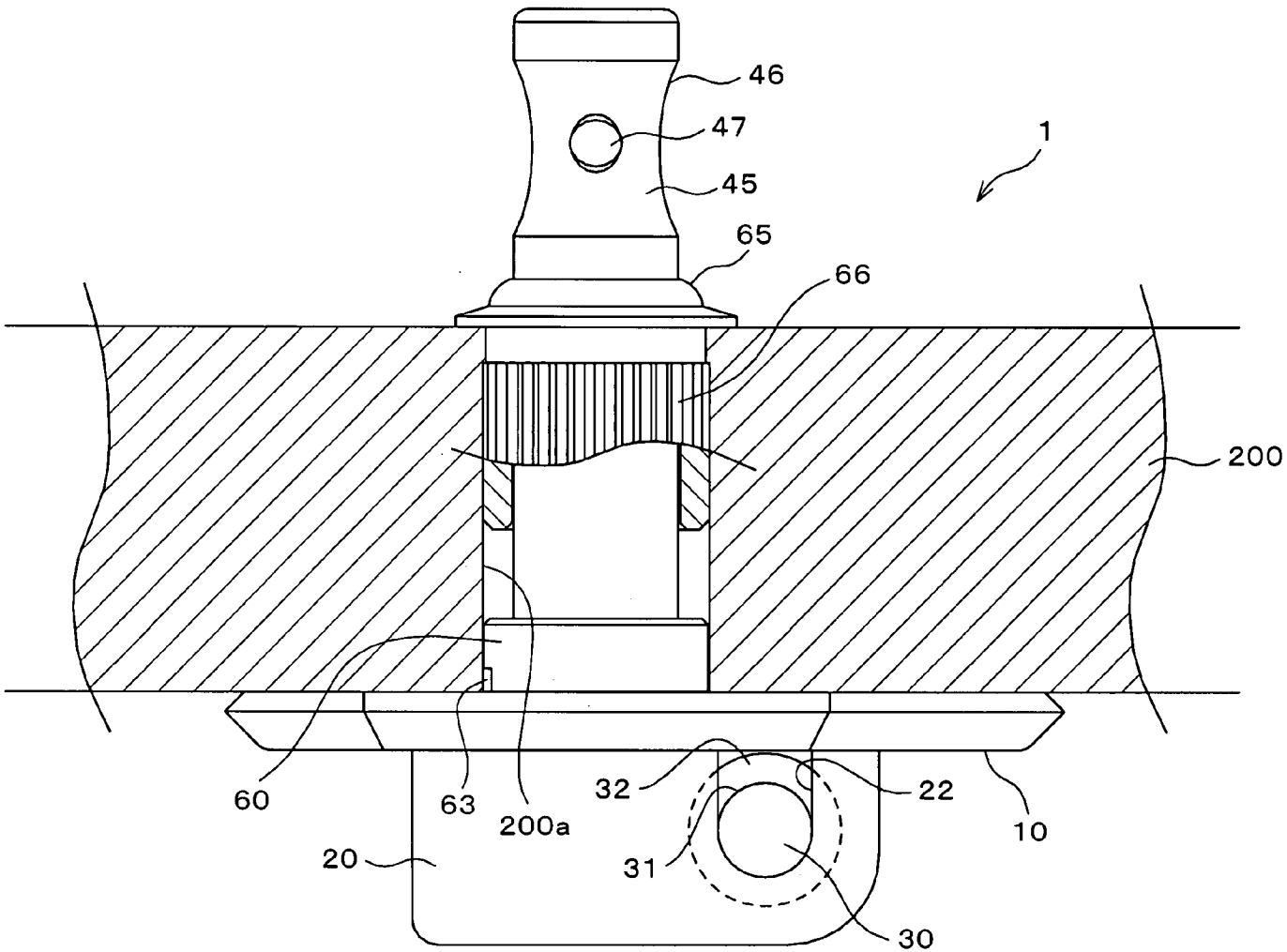
FIG. 1 shows a peg of the First Embodiment according to the present invention, and a side view showing the condition in which the peg is mounted to a head of a stringed instrument.
Figure 2:
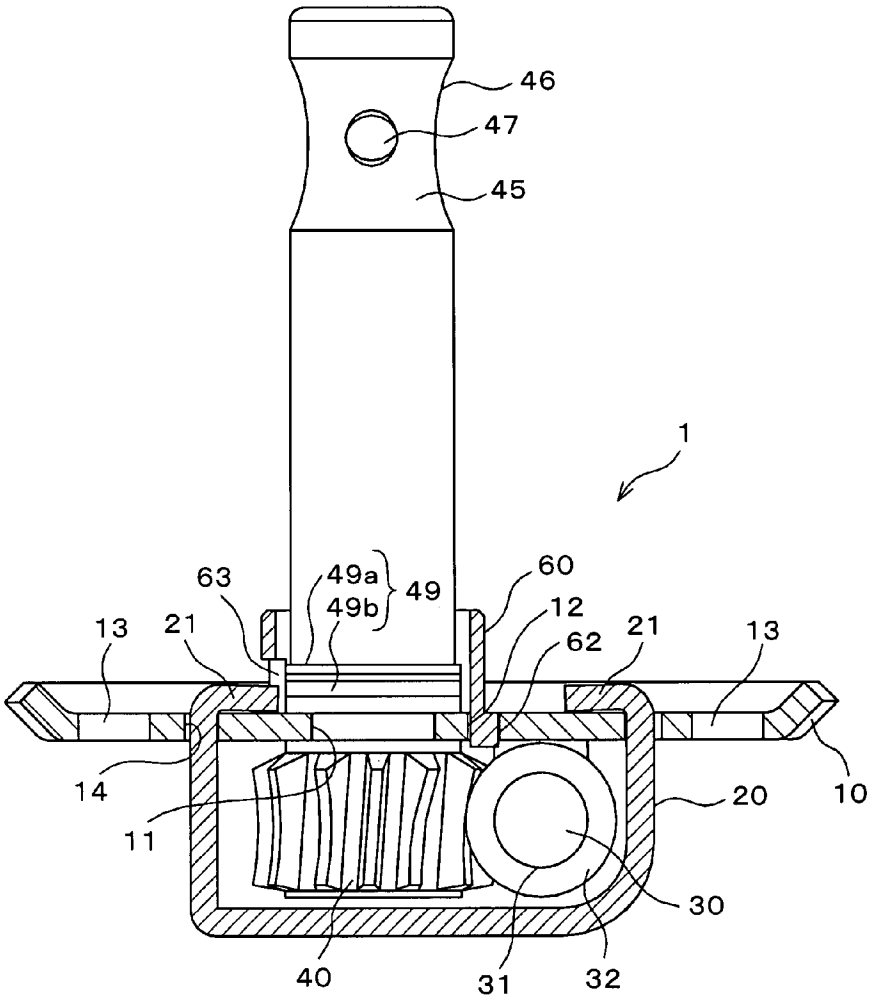
FIG. 2 is a cross-sectional view of the peg shown in FIG. 1.
Figure 3:
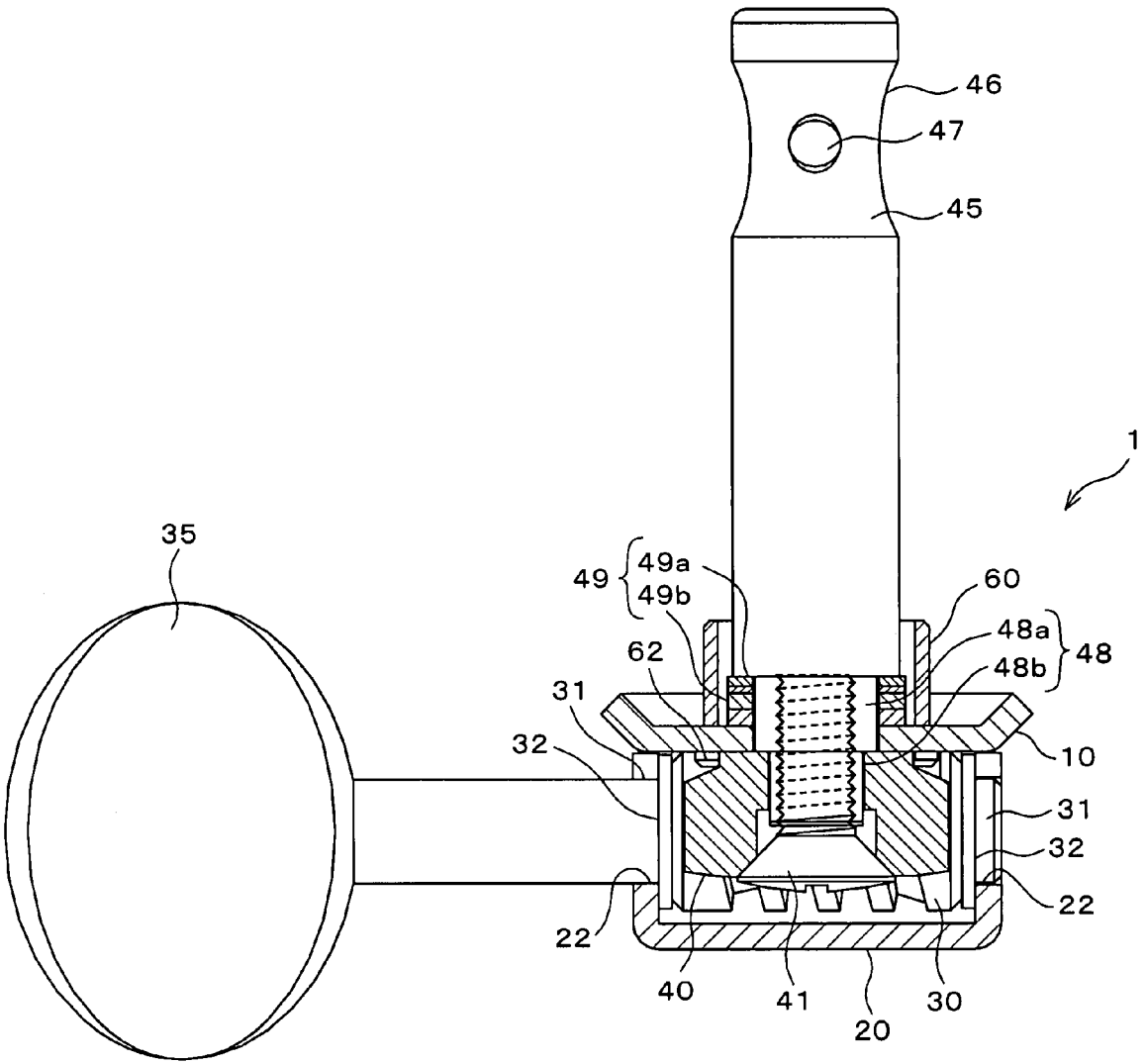
FIG. 3 is a cross-sectional view orthogonal to FIG. 2 showing the peg.

The First Embodiment of the present invention will be explained with reference to FIGS. 1 to 5D. FIGS. 1 to 3 show a schematic construction of a peg 1 of the First Embodiment according to the present invention. FIG. 1 is a side view showing the condition in which the peg 1 is mounted to a head 200 of a stringed instrument. FIG. 2 is a cross-sectional view of FIG. 1. FIG. 3 is a cross-sectional view orthogonal to FIG. 2. First, an overall schematic construction of the peg 1 will be explained. In the Figures, reference numeral 10 denotes a main body 1 of the peg 10, and reference numeral 20 denotes a cover 20. A worm gear 30 is rotatably supported between the cover 20 and the main body 10. A knob 35 (shown in FIG. 3) for rotating the worm gear 30 is mounted to the worm gear 30. A worm wheel 40 engages with the worm gear 30. A winding shaft 45 penetrates a hole 200*a* formed in the head 200. A lower end portion of the winding shaft 45 is mounted to the worm wheel 40.

Figure 4A:
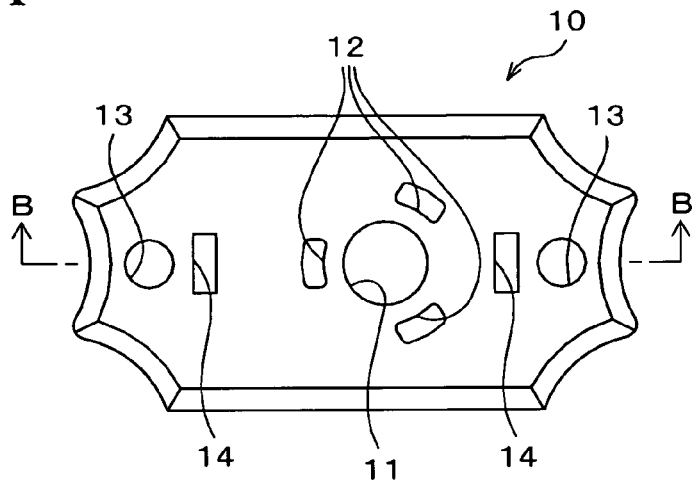
FIGS. 4A to 4D are views showing a main body of the peg.
Figure 4B:
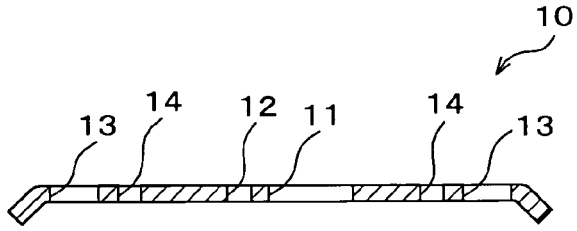

Next, the details of the respective parts of the peg 1 will be explained. FIG. 4A is a plan view of the main body 10. FIG. 4B is a cross-sectional view of the main body 10. The main body 10 is composed of a metal plate, for example, a steel plate which is made by press working. In the condition in which the main body 10 is mounted to the head 200, a space between the main body 10 and the head 200 is formed by folding an edge portion of the overall periphery of the main body 10. A support hole 11 is formed at a center portion of the main body 10. A lower end portion of the winding shaft 45 is rotatably supported by the support hole 11. Plural (in the First Embodiment, three) insertion holes 12 are formed on the periphery of the support hole 11 at equal intervals. Mounting holes 13 are formed at both end portions of the main body 10. Cover mounting holes 14 are formed between the mounting hole 13 and the support hole 11.

The main body 10 is mounted to the head 200 by screws (not shown in the Figures) penetrating the mounting holes 13. Tongue end portions 21 formed on the cover 20 are inserted into the cover mounting holes 14, and are folded inwardly so that the cover 20 is caulked to the main body 10. The cover 20 has a box-form which is formed by folding a substantially cross-shaped metal plate so as to have an open surface (a surface facing the main body 10). A U-shaped bearing 22 is formed on two surfaces of the cover 20 which face each other.

A worm shaft 31 is formed at two end portions of the worm gear 30. The knob 35 is mounted to the end portion of the worm shaft 31. The worm shaft 31 is provided in the above bearing 22. A plastic ring 32 is fitted in the worm shaft 31. As shown in FIG. 3, the worm shaft 31 is prevented from moving downwardly, to the left, and to the right by the bearing 22 of the cover 20. The worm shaft 31 is prevented from moving upwardly by the ring 32. In the condition in which the movement of the worm gear 30 is prevented, the worm gear 30 is rotatably supported by the cover 20 and the main body 10.

A winding surface 46 is formed at an end portion of the winding shaft 45. The winding surface 46 has a constriction, and a diameter of a center portion of the constriction is smaller than that of a portion therearound. A penetration hole 47 is formed at the center portion of the winding surface 46. An end portion of a string is inserted to the penetration hole 47, and the string is wound around the winding surface 46. A mounting shaft 48 is formed at the other end portion of the winding shaft 45. The mounting shaft 48 has a large diameter portion 48*a* and a small diameter portion 48*b*. The large diameter portion 48*a* is rotatably supported by the supporting hole 11 of the main body 10. The small diameter portion 48*b* is fitted into the worm wheel 40 without rotating with respect to the worm wheel 40, and a screw 41 is tightened to a lower end portion of the small diameter portion 48*b*, so that the small diameter portion 48*b* is mounted to the worm wheel 40. In FIG. 3, reference numeral 49 denotes a washer lamination having a resin washer 49*a*, a spring washer 49*b*, and so on. The washer lamination 49 reduces rotational resistance of the winding shaft 45.

A guide tube (guide member) 60 is provided in the peg 1 of the First Embodiment, so that a center of the winding shaft 45 is concentric with respect to that of the hole 200*a* of the head 200. A structure of the guide tube 60 will be explained. FIGS. 5A to 5D show a schematic structure of the guide tube 60. As shown in the Figures, the guide tube 60 is substantially cylindrical, and is composed of a synthetic resin, for example, a plastic. The guide tube 60 has a cylindrical portion 61. Plural (in the First Embodiment, three) projections 62 are formed at equal intervals at an end surface of the cylindrical portion 61 in a circumferential direction. A thick portion 62*a* is formed at each projection 62, and projects toward the outside of the radial direction of the projection 62. An inclined surface 62*b* is formed on each thick portion 62*a* so as to facilitate inserting the projection 62 into the insertion hole 12.

A notch 63 is formed on a region between the projections 62 at a bottom portion of the cylindrical portion 61. The notch 63 directs toward one side of the cover mounting hole 14 in the condition that the guide tube 60 is mounted to the main body 10, so that the tongue end portions 21 of the cover 20 do not interfere with the guide tube 60 when the tongue end portions 21 are folded.

Figure 4C:
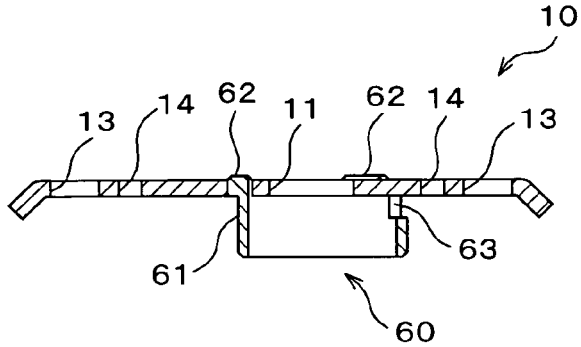

As shown in FIG. 4C, the guide tube 60 structured in the above manner is fixed to the main body 10 such that the projections 62 are inserted into the insertion holes 12 so as to slightly project therefrom, and the thick portions 62*a* projecting therefrom are melted by a soldering iron or the like. As shown in FIG. 1, the guide tube 60 is fitted into the hole 200*a* of the head 200, so that the center of the winding shaft 45 is concentric with respect to that of the hole 200*a*. A guide bush 65 is press-fitted into the hole 200*a* on the upper side of the head 200 so as to rotatably support the winding shaft 45. A serration 66 is formed on a peripheral surface of the guide bush 65, and prevents rotation and removal of the guide bush 65.

The following processes are executed for mounting the peg 1 to the head 200, wherein the peg 1 is structured in the above manner. First, the guide bush 65 is press-fitted from the upper side of the head 200 into the hole 200*a*. Next, the winding shaft 45 is inserted from the lower side of the head 200 into the hole 200*a*. The guide tube 60 is fitted into the hole 200*a*, and the winding shaft 45 is simultaneously fitted into the guide bush 65. Next, the screw is inserted into the mounting hole 13 of the main body 10, and is tightened to a lower hole which is formed in the head 200 beforehand.

In the peg 1 for a stringed instrument according to the present invention, the guide tube 60 fitted into the hole 200*a* of the head 200 is inserted into the main body 10 along the axis of the winding shaft 45 so as to be fixed thereto. Therefore, when the peg 1 is mounted to the head 200, the guide tube 60 is fitted into the hole 200*a* of the head 200, so that the center of the winding shaft 45 can be concentric with respect to that of the hole 200*a*. Therefore, the center of the guide bush 65 is concentric with respect to that of the winding shaft 45, so that contact of the winding shaft 45 and the guide bush 65 can be prevented. As a result, the worm wheel 40 can be rotated smoothly, and backlash and parts wearing out quickly can be prevented.

In particular, in the First Embodiment, since the guide tube 60 is composed of a plastic, and the projections 62 of the guide tube 60 project from the insertion holes 12, and are melted by heating, so that the guide tube 60 is secured to the main body 10. Therefore, it is difficult to form a gap between the guide tube 60 and the main body 10, and noise which occurs due to resonance of the guide tube 60 can be prevented. Even in case in which the guide 60 is removed from the main body 10, noise which occurs due to hits of the guide tube 60 to an inside wall of the hole 200*a* can be small. Since the thick portions 62 a projecting toward the outside of the radial direction is provided in the First Embodiment, the width of each insertion hole 12 is large, and press working can thereby be easily performed. When the projections 62 project from the insertion holes 12, and are melted by the heating, the projecting amount of the thick portion 62*a* is small, and the melting process can thereby be simple.

2. Second Embodiment

The Second Embodiment of the present invention will be explained with reference to FIGS. 6 to 10C. The Second Embodiment is different from the First Embodiment in that a bearing of a worm gear has only a main body of a peg and does not use a cover. Therefore, in the following explanations of the Second Embodiment, the same reference numerals as those of the First Embodiment will be used for the same components as those of the First Embodiment, and the explanations of the corresponding components of the Second Embodiment will be omitted.

Figure 10A:
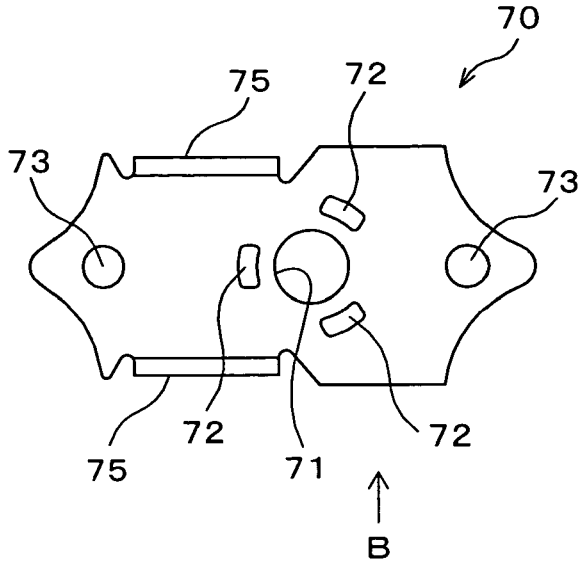
FIGS. 10A to 10C are views showing a main body of the Second Embodiment.
Figure 10B:
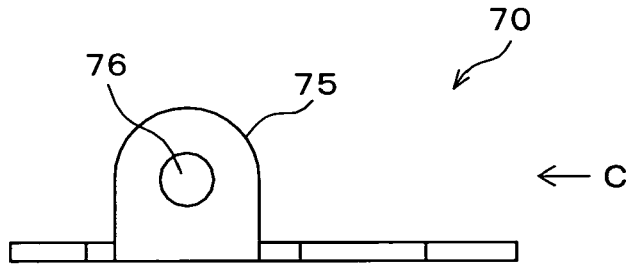
Figure 10C:
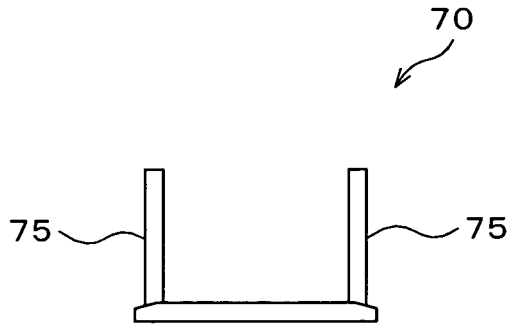
Figure 11:
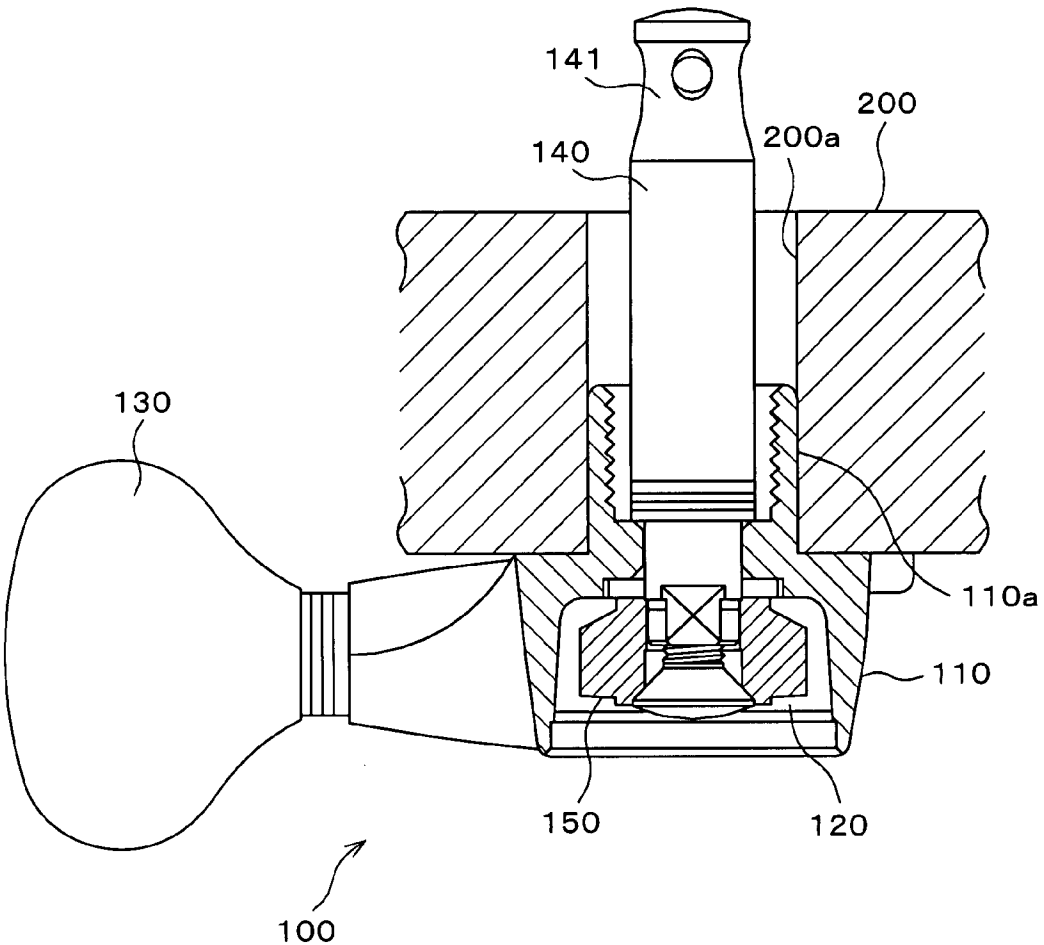
FIG. 11 is a cross-sectional view showing a conventional peg.

In the Figures, reference numeral 70 denotes a main body of a peg 2, and the details thereof are shown in FIGS. 10A to 10C. The main body 70 is composed of a metal plate, for example, a steel plate which is made by press working. A support hole 71 is formed at a center portion of the main body 70. A lower end portion of the winding shaft 45 is rotatably supported by the support hole 71. Plural (in the Second Embodiment, three) insertion holes 72 are formed on the periphery of the support hole 71 in the circumferential direction at equal intervals. Mounting holes 73 are formed at both end portions of the main body 70. The both side portions of the main body 70 are folded substantially perpendicular to a base portion of the main body 70, so that a bearing 75 is formed. A bearing hole 76 is formed at the center of the bearing 75. The worm shaft 31 which is formed at both end portions of the worm gear 30 is supported by the bearing hole 76. The main body 70 is mounted to the head 200 by a screw (not shown in the Figures) penetrating the mounting hole 73.

Figure 8:
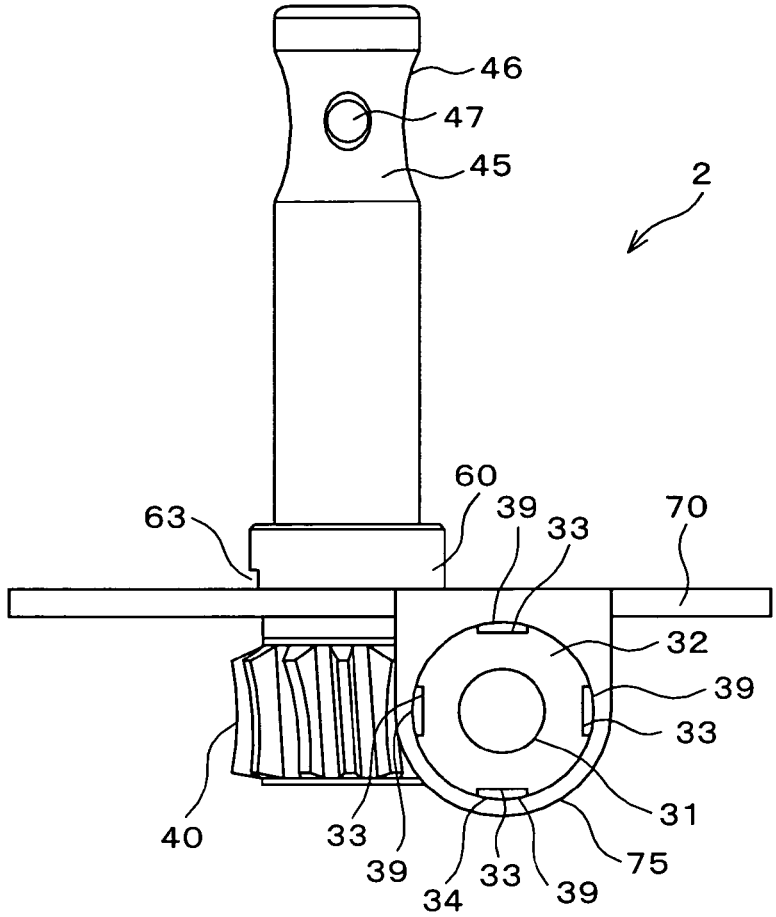
FIG. 8 is a view viewed from an arrow line VIII in FIG. 7.
Figure 9:
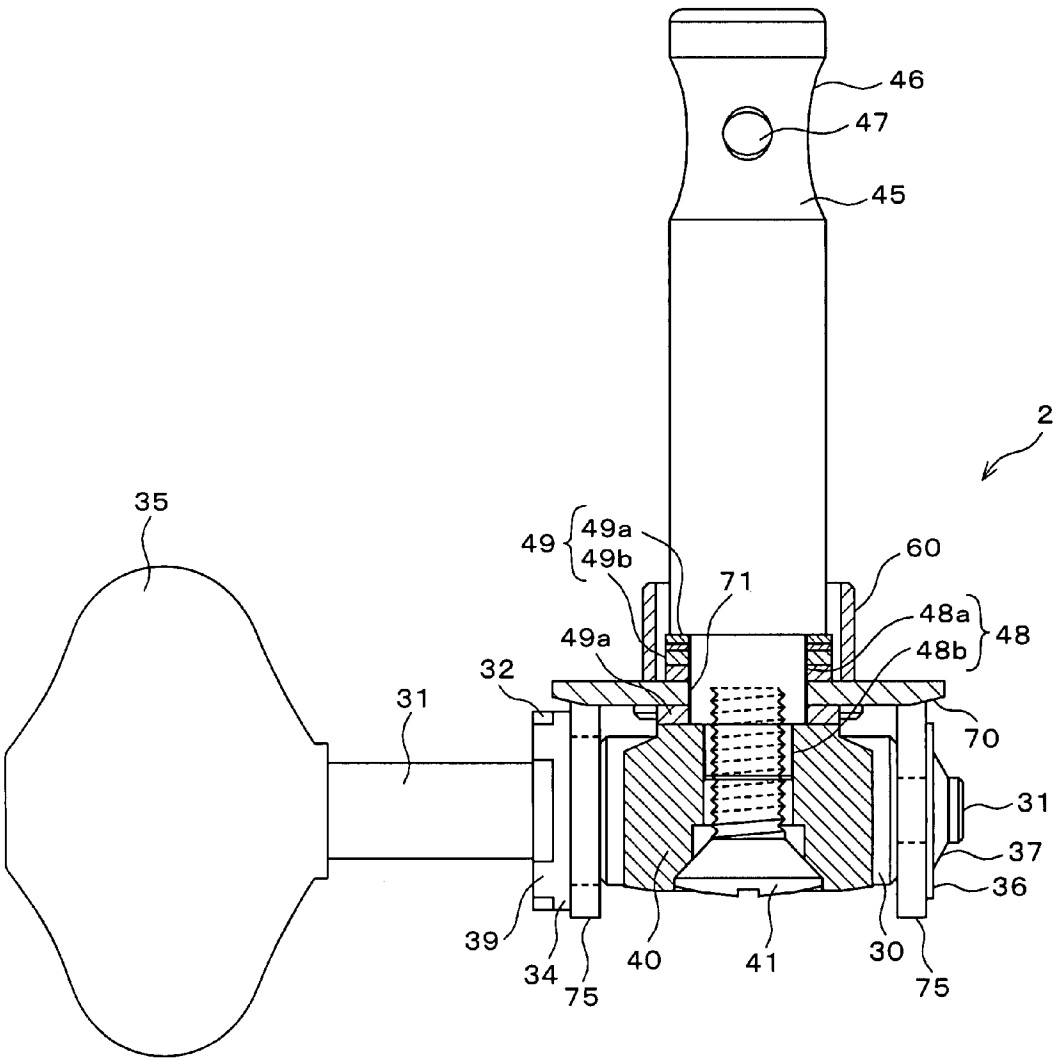
FIG. 9 is a cross-sectional view of the peg in the Second Embodiment.

A flange 32 is formed at the worm shaft 31. As shown in FIG. 8, plural (in the Second Embodiment, four) notches 33 are formed at equal intervals at the periphery of the flange 32 in the circumferential direction. A resin washer 34 is disposed between the flange 32 and the bearing 75 of the main body 70. Plural (in the Second Embodiment, four) projections 39 are formed at peripheral edges of a surface of the resin washer 34. The projections 39 are fitted into the notches 33 of the flange 32, so that the resin washer 34 is rotated together with the flange 32. The resin washer 36 is fitted into an end portion opposite to the flange 32 of the worm shaft 31. The resin washer 36 is pressed by a bush nut 37 toward the bearing 75. In the Second Embodiment, a resin washer 49*a* is disposed between the worm wheel 40 and the main body 70. In the peg 2 of the Second Embodiment, a guide tube 60 has the same structure as that of the First Embodiment. Therefore, in the Second Embodiment, the same actions and the effects as those of the First Embodiment can be obtained.

3. Modification Example

Figure 4D:
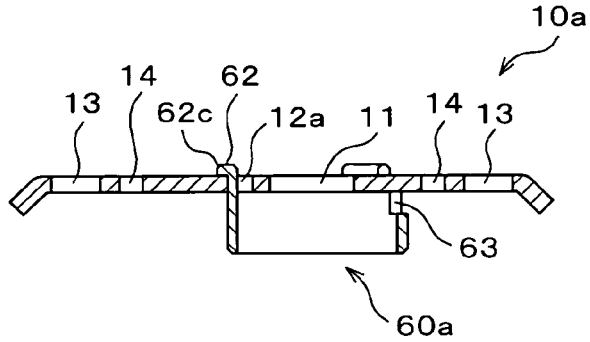
Figure 5A:
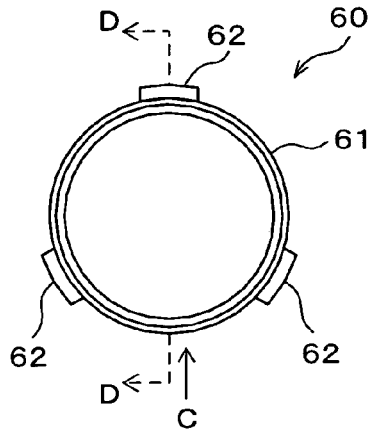
FIGS. 5A to 5D are views showing a guide member.
Figure 5B:
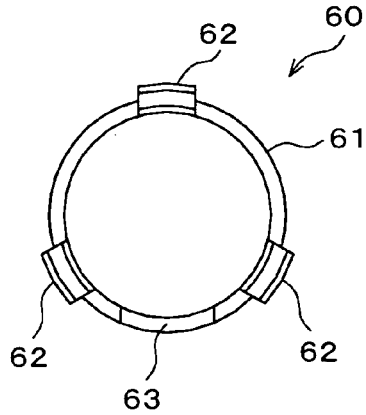
Figure 5C:
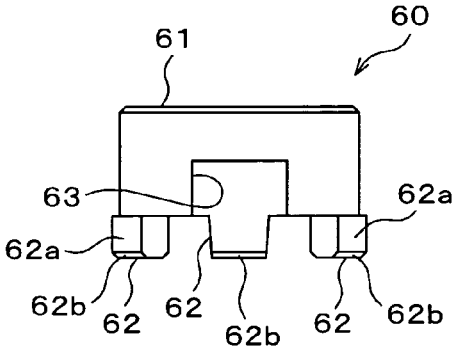
Figure 5D:
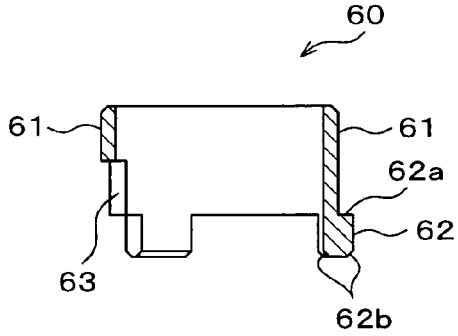
Figure 6:
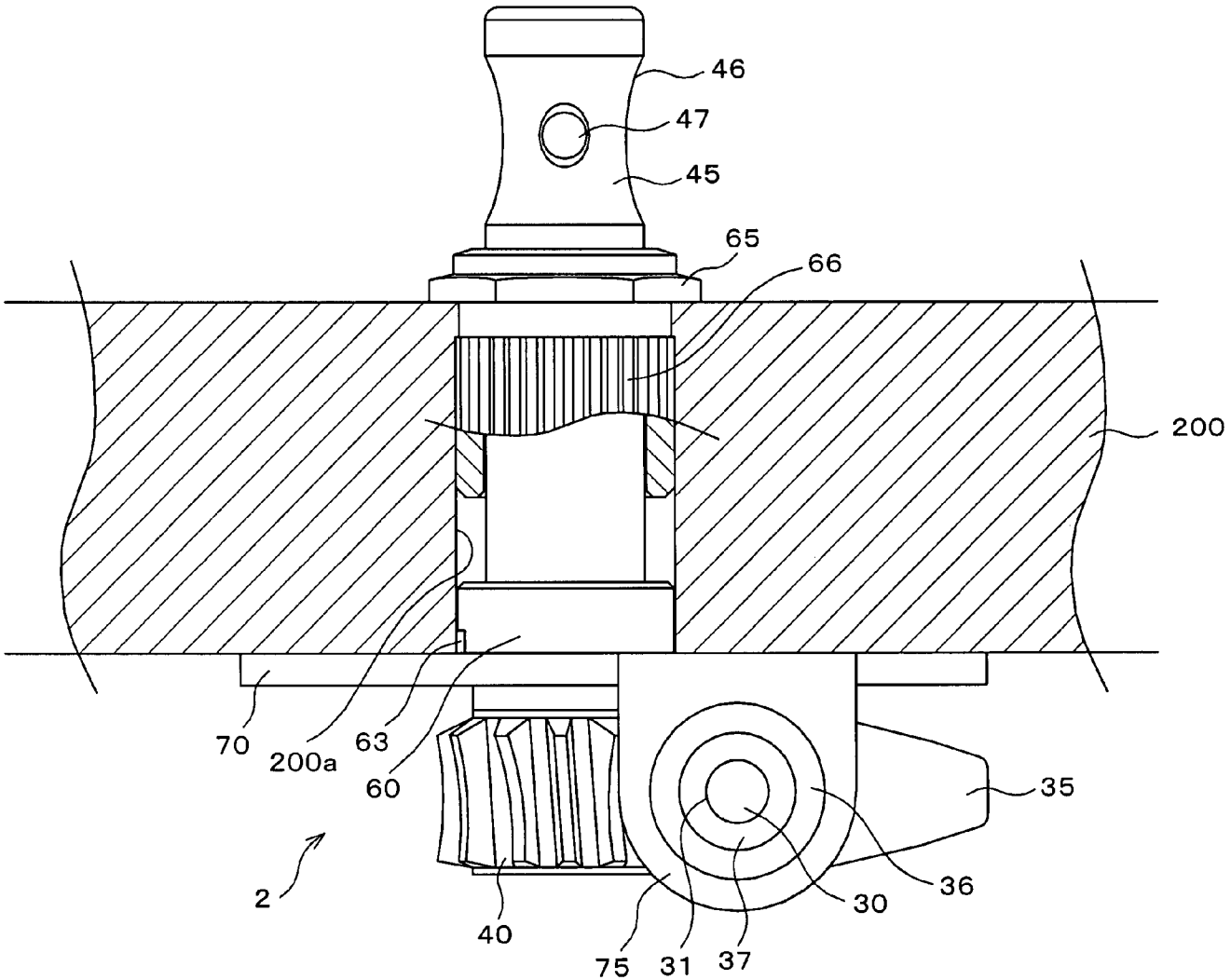
FIG. 6 shows a peg in the Second Embodiment according to the present invention, and a side view showing the condition in which the peg is mounted to a head of a stringed instrument.
Figure 7:
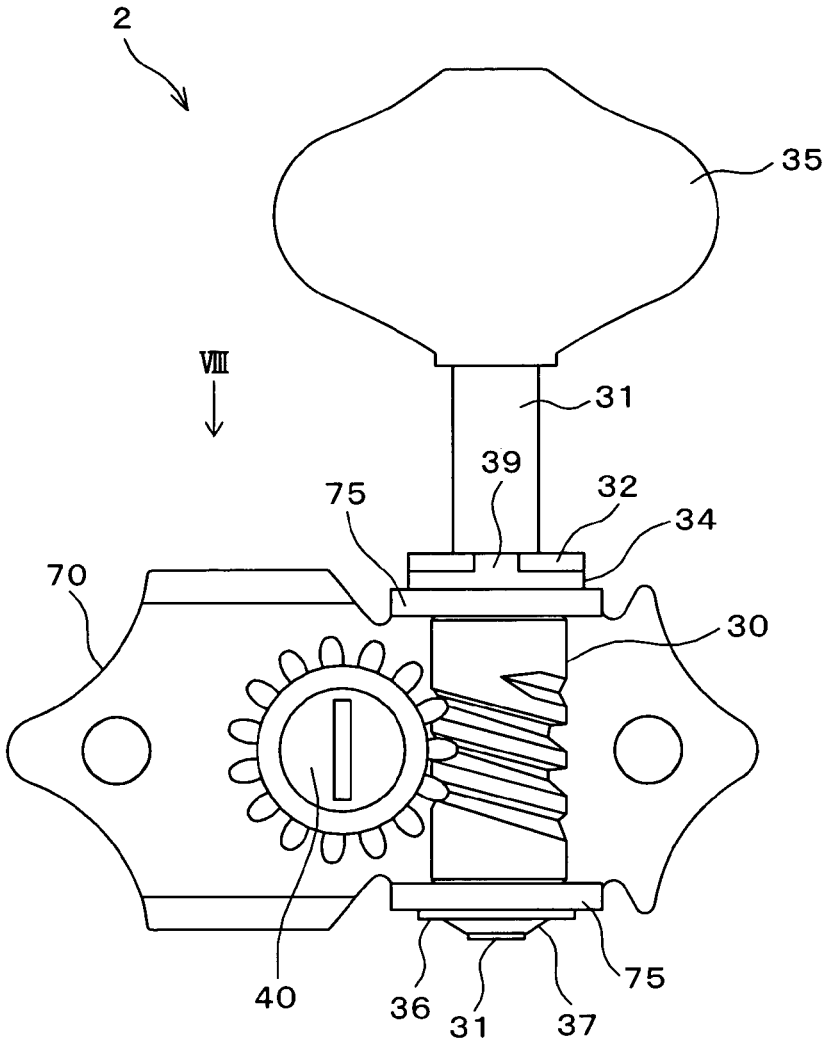
FIG. 7 is a rear surface view of the peg in the Second Embodiment.

FIG. 4D shows a modification example of the First Embodiment. The modification example can be applied to the Second Embodiment. As shown in FIG. 4D, a hook 62*c* projecting toward the outside is formed at an end portion of the projection 62 of the guide tube 60*a*. A surface of the hook 72*c* which directs toward the outside is an inclined surface. The inclined surface is inclined downward as the inclined surface is directed toward the outside. The insertion holes 12*a* of the main body 10*a* have widths greater than those of the First Embodiment such that the projections 62 including the hook 62*c* can pass through the insertion holes 12*a*.

In the modification example structured in the above manner, in case in which the projections 62 are inserted into the insertion holes 12*a*, the inclined surfaces are pressed by the edge portion of the insertion holes, so that the projections 62 are plastically deformed inwardly, and passes through. The hooks 62*c* are projected from the insertion holes 12*a*, so that the projections 62 elastically return to the initial condition, and the hooks 62*c* project outwardly, and engage with edge portions of the insertion holes 12*a*. As a result, the guide tube 60*a* is prevented from moving along the axis. In the modification example, the guide tube 60*a* can be very easily mounted to the main body 10*a* by one touch. Protrusion portions of the projections 62 are melted by heating so as to be secured to opening portions of the insertion holes 12*a*.

The present invention is not limited to the First and the Second Embodiments. For example, the present invention can be applied to pegs other than pegs in which a guide tube is formed to be integrally combined with a main body by die casting or the like. The present invention can be applied to various stringed instruments, for example, acoustic guitars, electric guitars, electric-acoustic guitars, bass guitars, mandolins, ukuleles and the like.

What is claimed is:

1. A peg for a stringed instrument having a head and a hole formed in the head, comprising:

a main body which is mounted to the head;

a worm gear rotatably provided to the main body and having a knob on an end portion thereof;

a worm wheel rotatably supported by the main body and engaging with the worm gear;

a winding shaft connected to the worm wheel and inserted into the hole of the head in the condition that the main body is mounted to the head; and a ring-shaped guide member penetrated by the winding shaft and fitted into the hole of the head, wherein the main body is formed by press forming a metal plate and has a supporting hole for rotatably supporting the winding shaft and plural insertion holes which are outwardly separated from the supporting hole and are disposed in a circumferential direction so as to be overlapped with a ring-shaped end surface of the guide member, the supporting hole and the insertion holes being formed by press forming, and wherein the guide member has projections which are projected from the ring-shaped end surface of the guide member in an axial direction of the winding shaft and are inserted into the insertion holes of the main body, the guide member and the projections are composed of plastic material, and the projections are projected from the insertion holes of the main body, and are secured by melting by heating so as to be secured to the insertion holes, whereby the guide member is secured to the main body.

2. The peg for a stringed instrument according to claim 1, wherein the projections have a hook portion which projects toward an outside in a radial direction of the guide member, whereby the projections are elastically deformed inwardly to be inserted into the insertion holes, so that the hook portions elastically return and engage with edge portions of the insertion holes.

3. The peg for a stringed instrument according to claim 1, wherein a cover is attached to the main body by caulking, and the cover is formed with bearing portions for rotatably supporting the worm gear.

4. The peg for a stringed instrument according to claim 1, wherein the main body has side projected portions, which are folded substantially perpendicular to a base portion of the main body, and a bearing portion for rotatably supporting the worm gear is formed in each side projected portion.

* * * * *

UNITED STATES PATENT AND TRADEMARK OFFICE

CERTIFICATE OF CORRECTION

PATENT NO. : 7,488,879 B2
APPLICATION NO. : 11/288899
DATED : February 10, 2009
INVENTOR(S) : Takao Goto It is certified that error appears in the above-identified patent and that said Letters Patent is hereby corrected as shown below:

On The Title Page, Item (73)
Inventors: "Gotoh" should read "Goto"

Signed and Sealed this

Fifth Day of May, 2009

JOHN DOLL
*Acting Director of the United States Patent and Trademark Office*